United States Patent [19]

Brockmüller et al.

[11] 4,183,518

[45] Jan. 15, 1980

[54] APPARATUS FOR SEPARATING IN GROUPS A PREDETERMINED NUMBER OF CONTINUOUSLY FED FLAT WORKPIECES OVERLAPPING IN SCALE FORMATION

[75] Inventors: Friedrich-Franz Brockmüller; Richard Feldkämper, both of Lengerich; Erwin Meyer, Lotte, all of Fed. Rep. of Germany

[73] Assignee: Windmoller & Holscher, Westphalia, Fed. Rep. of Germany

[21] Appl. No.: 850,199

[22] Filed: Nov. 10, 1977

[30] Foreign Application Priority Data

Nov. 12, 1976 [DE] Fed. Rep. of Germany ..... 2651690

[51] Int. Cl.[2] ..... B65H 29/68

[52] U.S. Cl. ..... 271/182; 198/425; 271/202

[58] Field of Search ..... 271/182, 183, 202, 198, 271/256, 229, 230, 231; 93/93 DP; 198/425

[56] References Cited

U.S. PATENT DOCUMENTS

| | | | |
|---|---|---|---|
| 3,708,162 | 1/1973 | Skudlarek | 271/256 |
| 3,724,840 | 4/1973 | Kuckhermann | 271/182 |

*Primary Examiner*—Bruce H. Stoner, Jr.
*Attorney, Agent, or Firm*—Fleit & Jacobson

[57] ABSTRACT

Overlapping sheet articles continuously arriving on a belt conveyor are separated into groups by brake bands which are intermittently pressed against respective rails disposed between the belts substantially flush with the conveying runs. The brake bands lie loosely on the sheet articles which pass thereunder unimpeded until they are to be temporarily halted, which is done by successively lowering a plurality of weights on the brake bands starting at the leading ends of the brake bands.

7 Claims, 3 Drawing Figures

II
II
1
1.1
2
3
4
5
6
7
8
9
9.1
10
11
12
13
13.1
14
14.1
15
16
17

APPARATUS FOR SEPARATING IN GROUPS A PREDETERMINED NUMBER OF CONTINUOUSLY FED FLAT WORKPIECES OVERLAPPING IN SCALE FORMATION

The invention relates to an apparatus for separating in groups a predetermined number of continuously fed flat workpieces, tube sections, empty sacks, bags or the like which are successively deposited on a belt conveyor and overlap one another in scale formation, the conveyor comprising individual parallel circulating belts between which slide rails are arranged substantially flush with the conveying runs, separation being effected with the aid of brake bands disposed one above each slide rail.

In an apparatus of this kind known from DT-PS No. 2 022 045, the brake bands are pressed against the workpieces which overlap in scale formation by means of pressure rollers mounted on a continuously displaced carriage, the speed of the carriage being tuned to the speed of the belt conveyor so that the spacings of the workpieces overlapping in scale formation are as equal as possible as they are banked up. Pressing on of the brake bands by the progressive movement of the pressure rollers acting on the brake bands requires an elaborate construction which makes the apparatus more expensive.

It is therefore the problem of the invention to provide an apparatus which simplifies and cheapens the known apparatus for separating in groups a predetermined number of continuously fed workpieces which overlap in scale formation.

This problem is solved according to the invention in that the brake bands lie loosely on the slide rails and can be loaded by weights which are distributed lengthwise of the brake bands and can be successively lowered onto the brake bands against the conveying direction. In the apparatus according to the invention the brake bands secured at both ends to the frame of the machine hang slack on the slide rails so that, without the weights loading same, they do not hinder the passage of the fed workpieces. However, the brake bands when gradually loaded by the weights in their longitudinal direction against the conveying direction hold the arriving flat workpieces still without the latter being able to change their as yet equal scale spacings in an uncontrollable manner, even though the spacings are reduced. With the apparatus of the invention that can be made simply and economically, it is therefore possible to achieve a regular banking up in scale formation to separate groups of workpieces.

Desirably, the weights are arranged in longitudinal bars which can be lowered onto the brake bands so that the lowering and raising of the weights can be effected in a simple manner. Preferably the weights comprise bolts slidably mounted in the longitudinal bars.

In a further development of the invention, clamping jaws moved by common control means can be applied to and withdrawn from the weight-carrying pins or their shanks. Without such clamping means, the weights would be successively raised from the brake bands during lifting of the longitudinal bars so that the workpieces in the banked-up scale formation would become displaced relatively to one another and produce irregular spacings therebetween.

Desirably, the bolts are provided with screwthreads on which nuts can be screwed for adjusting the effective lengths of the bolts. This permits the application of the weights to the brake bands to be easily adjusted in relation to the lowering movement of the longitudinal bars.

Other advantageous embodiments of the invention are described in more detail in the subsidiary claims.

An example of the invention will now be described in more detail with reference to the drawing, wherein.

Figures 1, 2:
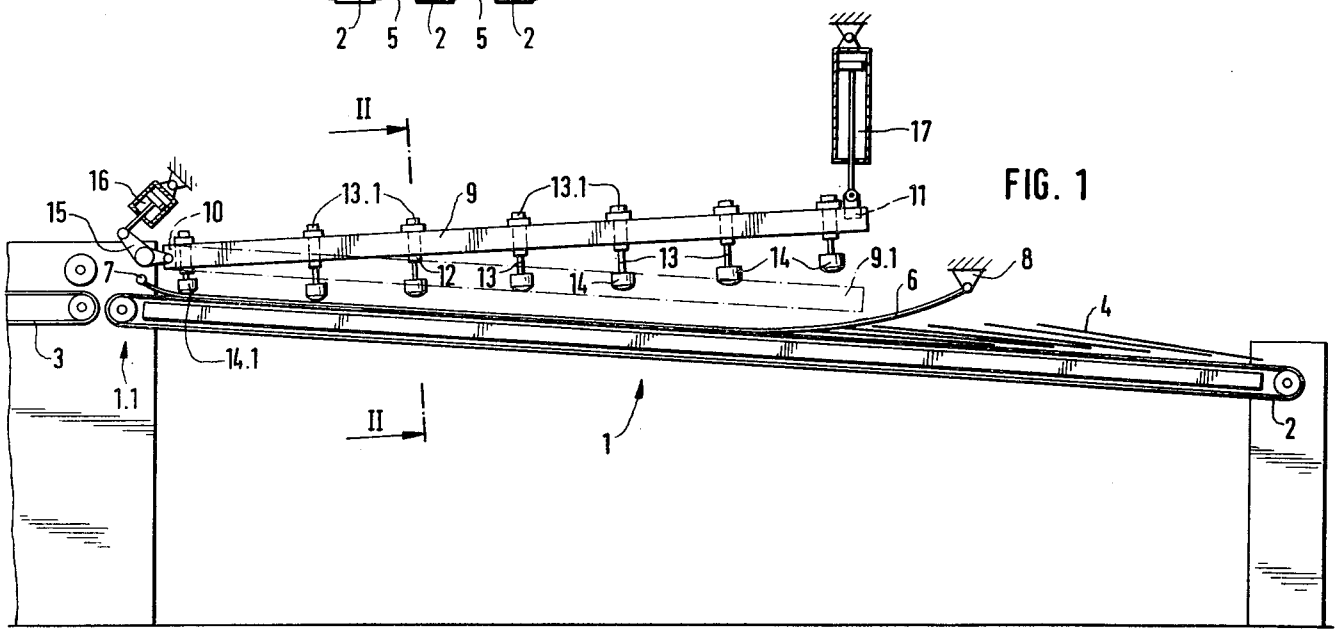
FIG. 1 is a diagrammatic side elevation of the apparatus for separating in groups continuously fed articles which overlap in scale formation.
FIG. 2 is a section on the line II—II in FIG. 1.

A belt conveyor 1 consisting of continuously fed conveyor belts 2 is followed by a feed belt 3 which adjoins a known packet-forming station (not shown). From a working machine (not shown), for example a tube drawing or base forming machine, workpieces 4 are deposited at equal spacings on the belt conveyor 1 and they there form a scale formation because the conveyor belts 2 move at a slower speed than the conveying speed of the sacks 4.

Between, say, three juxtaposed conveyor belts 2 there are slide rails 5 (see FIG. 2) of which the elevation can be set relatively to the conveying faces of the individual belts. Loosely lying on the slide rails 5 there are brake bands 6 which are secured at their ends 7, 8 to the frame of the machine.

The workpieces 4 applied to the belt conveyor 1 run unimpeded beneath the brake bands 6 so that their scale formation is not disturbed because the brake bands 6 have only a very low weight.

Arranged above the slide rails 5 or the brake bands 6 there are longitudinal bars 9 having their ends interconnected by cross-bars 10, 11. Bolts 13 are slidingly mounted in guide sleeves 12 secured in the longitudinal bars 9. Weights 14 are fixed to the bolts 13 of which the effective lengths can be adjusted by nuts 13.1. Hinged to the cross-bar 10 there is one arm of a double lever 15 which is rotatably mounted in the frame, the other arm being hinged to the piston rod of a lifting cylinder 16. The lifting cylinder 16 is pivotably mounted in the frame. The piston rod of a lifting cylinder 17 is hinged to the cross-bar 11 and is likewise pivoted to the frame of the machine.

By actuating the lifting 16, the one end of the longitudinal bars 9 is lowered so that first of all only the weights designated 14.1 become seated on the brake bands 6. By actuating the lifting cylinder 17, the other end of the longitudinal bars 9 can be lowered to the position 9.1. By appropriately adjusting the effective lengths of the bolts 13 by turning the nuts 13.1, one ensures that one weight 14 after the other is placed on the brake bands 6 in the same sequence as they are arranged along the longitudinal bar.

The apparatus functions as follows. The workpieces 4 deposited on the belt conveyor 1 in scale formation slide without hindrance beneath the brake bands 6 and are fed to the packet-forming station by way of the feed belt 3. After the feed belt 3 has delivered the number of workpieces 4 desired to form the packet, the lifting cylinder 16 is actuated so that the weights 14.1 press on the brake bands 6 or onto the sacks 4 arriving in overlapping sequence and press the sacks against the slide rails 5. The trailing end of the first workpiece 4 of the group to be held stationary is thus engaged whereas the preceding workpiece 4 continues to be fed by the feed belt 3 onto the packet being formed together with the other workpieces 4 disposed between the delivery end 1.1 and the packet-forming station, until the packet has reached the desired height or the desired number of workpieces 4.

The scale formation banks up behind the first article 4 that is halted between the slide rails 5 and the brake bands 6 by the weight 14.1. After a certain time or simultaneously, depending on the property and length of the conveyed workpieces 4 and on the operating speed of the machine, the lifting cylinder 17 is actuated and the weights 14 are lowered in sequence onto the brake bands 6. This prevents further pushing together of workpieces 4 successively in the region of the weights 14 that are already lying on the brake band 6, so that an equal scale spacing is maintained which enhances the formation of edge-aligned packets.

The control of the lifting cylinders 16, 17 is effected by signals of a counter (not shown) which determines the number of workpieces 4 successively fed in scale formation on the belt conveyor 1. The delivery of a signal from the counter can be set in known manner to the desired number of workpieces 4 which are to be combined to form a packet.

Instead of the described weights, use can also be made of springs, spring-loaded push members or pressure medium cylinders.

Figure 3:
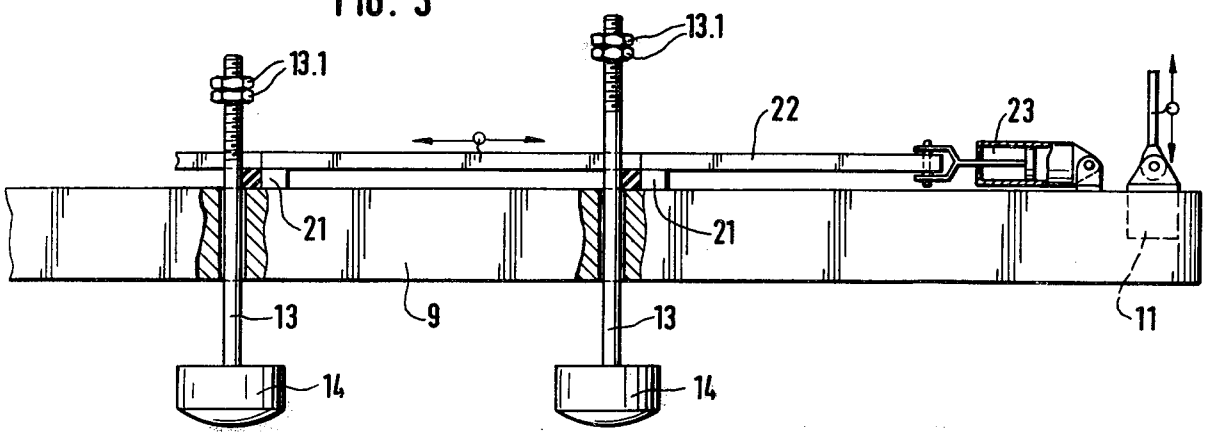
FIG. 3 shows a part of the longitudinal bars carrying the brake weights with clamping jaws acting on the shanks of the weights.

FIG. 3 illustrates a longitudinal bar 9 in which bolts 13 carrying weights 14 are slidingly mounted, the bolts being adapted to be clamped for the purpose of uniformly lifting the weights from the brake bands. The clamping means consist of a number of clamping jaws 21 having an elastic coating and together secured on bars 22. The bars 22 are easily displaceable on the longitudinal bars 9 and connected to the piston rod of a lifting cylinder 23. The elastic coatings serve to ensure that all the bolts 13 will be positively clamped even if there are certain differences in the spacing and inaccuracies in fits.

The lifting cylinder 23 is actuated at the instant in which the banked-up scale formation is to be released by lifting the longitudinal bars 9. All the bolts and thus also all the weights 14 are lifted simultaneously with raising the longitudinal bar 9 from the brake band so that undesirable displacement of the workpieces in the scale formation is avoided.

We claim:

1. Apparatus for separating in groups a predetermined number of continuously fed flat workpieces, tube sections, empty sacks, bags or the like which are successively deposited on a belt conveyor and overlap one another in scale formation, the conveyor comprising individual parallel circulating belts, slide rails arranged between and substantially flush with the conveying runs, brake bands disposed one above each slide rail for effecting separation of the workpieces, the brake bands being movable between first and second positions, in the first positions the brake bands lying loosely on the slide rails so that workpieces can pass between the brake bands and the slide rails, in the second positions the brake bands being urged towards the rails to stop movement of the workpieces, weights distributed lengthwise of the brake bands, longitudinal bars positioned above the brake bands for mounting the weights, and means for moving the bars toward the brake bands so that the weights are successively lowered onto the brake bands against the conveying direction thereby moving the brake bands into the second positions.

2. Apparatus according to claim 1, wherein the weights comprise bolts slidably mounted in the longitudinal bars.

3. Apparatus according to claim 2, further comprising clamping jaws, and common control means for applying and for withdrawing the clamping jaws from the bolts.

4. Apparatus according to claim 3, further comprising rods for securing the clamping jaws, means for guiding the rods on the longitudinal bars, and a piston-cylinder unit for advancing and for retracting the rods.

5. Apparatus according to claim 4, wherein the clamping jaws are provided with an elastic coating.

6. Apparatus according to claim 1 wherein the weights include bolts provided with screwthreads, and wherein the apparatus further comprises nuts screwed on the bolts for adjusting the effective length of the bolts.

7. Apparatus according to claim 1 wherein the means for moving the bars comprises lifting cylinders connected to ends of the bars.

* * * * *